US009518593B2

(12) United States Patent
Mori et al.

(10) Patent No.: US 9,518,593 B2
(45) Date of Patent: Dec. 13, 2016

(54) HYDRAULIC DRIVE SYSTEM FOR CONSTRUCTION MACHINE

(75) Inventors: Kazushige Mori, Koka (JP); Kiwamu Takahashi, Koka (JP); Yoshifumi Takebayashi, Koka (JP); Natsuki Nakamura, Koka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 349 days.

(21) Appl. No.: 14/236,685

(22) PCT Filed: Aug. 28, 2012

(86) PCT No.: PCT/JP2012/071700
§ 371 (c)(1),
(2), (4) Date: Feb. 3, 2014

(87) PCT Pub. No.: WO2013/031768
PCT Pub. Date: Mar. 7, 2013

(65) Prior Publication Data

US 2014/0174068 A1 Jun. 26, 2014

(30) Foreign Application Priority Data

Aug. 31, 2011 (JP) ..... 2011-189966

(51) Int. Cl.
*F15B 21/14* (2006.01)
*F15B 15/02* (2006.01)
(Continued)

(52) U.S. Cl.
CPC ..... *F15B 15/02* (2013.01); *E02F 3/325* (2013.01); *E02F 9/207* (2013.01); *E02F 9/2075* (2013.01);
(Continued)

(58) Field of Classification Search
CPC ..... F15B 21/14
See application file for complete search history.

(56) References Cited

U.S. PATENT DOCUMENTS 6,192,681 B1 2/2001 Tsuruga et al.
7,565,801 B2 * 7/2009 Tozawa ..... E02F 9/2075 60/414
2011/0265467 A1 11/2011 Kawasaki

FOREIGN PATENT DOCUMENTS

JP 10-205501 A 8/1998
JP 2005-140143 A 6/2005
(Continued)

OTHER PUBLICATIONS

Japanese Office Action received in corresponding Japanese Application No. 2013-531325 dated May 12, 2015.
(Continued)

*Primary Examiner* — F. Daniel Lopez
(74) *Attorney, Agent, or Firm* — Mattingly & Malur, PC

(57) ABSTRACT

A hydraulic motor (52) is arranged in a control hydraulic line (51) connecting a second hydraulic fluid supply line (4*a*) (for supplying the hydraulic fluid delivered from the main pump (2) to flow control valves (26*a* to 26*h*)) to a tank (T). A generator (53) connected with the rotating shaft (52*a*) of the hydraulic motor (52). Maximum load pressure (PLmax) is detected by a pressure sensor (54). Power generation control of the generator (53) is performed by a second control device (55) so that the hydraulic motor (52) rotates when the delivery pressure of the main pump (2) exceeds target control pressure (Pun) determined by adding a preset value (Pb) to the maximum load pressure (PLmax). AC power generated by the generator (53) is stored in a battery (41).

4 Claims, 6 Drawing Sheets

(51) Int. Cl.

| | |
|---|---|
| ***F04B 49/06*** | (2006.01) |
| ***E02F 9/22*** | (2006.01) |
| ***F15B 11/16*** | (2006.01) |
| ***E02F 3/32*** | (2006.01) |
| ***E02F 9/20*** | (2006.01) |

(52) U.S. Cl.

CPC ..... *E02F 9/2217* (2013.01); *E02F 9/2232* (2013.01); *E02F 9/2285* (2013.01); *E02F 9/2296* (2013.01); *F04B 49/06* (2013.01); *F15B 11/163* (2013.01); *F15B 11/168* (2013.01); *F15B 21/14* (2013.01); *F15B 2211/20546* (2013.01); *F15B 2211/30535* (2013.01); *F15B 2211/329* (2013.01); *F15B 2211/6058* (2013.01); *F15B 2211/71* (2013.01)

(56) References Cited

FOREIGN PATENT DOCUMENTS

| | | | |
|---|---|---|---|
| JP | 2008-063888 | A | 3/2008 |
| JP | 2011-17427 | A | 1/2011 |

OTHER PUBLICATIONS

International Preliminary Report on Patentability received in International Application No. PCT/JP2012/071700 dated Mar. 13, 2014.

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator, and particularly to a hydraulic drive system that controls the delivery flow rate of the hydraulic pump so that the delivery pressure of the hydraulic pump becomes higher than the maximum load pressure of a plurality of actuators by a target differential pressure.

BACKGROUND ART

Hydraulic drive systems of conventional construction machines (e.g., hydraulic excavators) include those controlling the delivery flow rate of the hydraulic pump (main pump) so that the delivery pressure of the hydraulic pump becomes higher than the maximum load pressure of a plurality of actuators by a target differential pressure. This control is called "load sensing control". In such a hydraulic drive system performing the load sensing control, the differential pressure across each of a plurality of flow control valves is kept at a prescribed differential pressure by use of a pressure compensating valve so as to make it possible during the combined operation (operation of a plurality of actuators at the same time) to supply the hydraulic fluid according to a ratio corresponding to the opening areas of the flow control valves irrespective of the magnitude of the load pressure of each actuator.

Such a hydraulic drive system performing the load sensing control is described in JP,A 10-205501, for example. In the conventional technology, an unload valve is connected to a hydraulic fluid supply line to which the hydraulic fluid delivered from the main pump is led. The unload valve operates mainly in conditions in which the flow control valves are not operating (neutral state), limits the pressure in the hydraulic fluid supply line of the main pump (delivery pressure of the main pump) below a preset pressure of a main relief valve, and returns the delivery flow of the main pump to a tank in the neutral state. For this purpose, the unload valve is equipped with a spring for setting a target unload pressure and acting on the valve in the valve-closing direction. The delivery pressure of the main pump and the maximum load pressure are led to the unload valve to act on the valve in the valve-opening direction and in the valve-closing direction, respectively. The hydraulic drive system is configured to lead the tank pressure (approximately 0 MPa) to the unload valve as the maximum load pressure in the neutral state. With this configuration, when the delivery pressure of the main pump exceeds the target unload pressure (set by the spring) in the neutral state, the unload valve opens, returns the delivery flow of the main pump to the tank, and thereby controls the delivery pressure of the main pump to keep it within the target unload pressure.

Further, when an actuator is driven, due to the characteristics of the above-described configuration, the unload valve controls the delivery pressure of the main pump to keep it within the sum of the maximum load pressure and the target unload pressure by returning part of the delivery flow of the main pump to the tank when the differential pressure between the delivery pressure of the main pump and the maximum load pressure exceeds the target unload pressure set by the spring of the unload valve.

PRIOR ART LITERATURE

Patent Literature

Patent Literature 1: JP,A 10-205501

SUMMARY OF THE INVENTION

Problem to be Solved by the Invention

A conventional hydraulic drive system performing the load sensing control like the one described in the Patent Literature 1 is equipped with the unload valve as explained above and avoids unnecessary increase in the delivery pressure of the main pump in the neutral state (in which the flow control valves are not operating) and in the actuator driving state, by returning the delivery flow of the main pump to the tank when the delivery pressure of the main pump is going to be the target unload pressure (set by the spring) or more higher than the maximum load pressure (tank pressure in the neutral state).

However, the returning of the delivery flow of the hydraulic pump to the tank via the unload valve is equivalent to wasting the energy of the hydraulic fluid generated by the main pump without using it, that deteriorates the energy consumption efficiency of the whole hydraulic drive system.

It is therefore the object of the present invention to provide a hydraulic drive system for a construction machine that performs the load sensing control and that is capable of achieving a function equivalent to that of a hydraulic drive system including the unload valve while also recovering the energy of the hydraulic fluid discharged from the main pump to the tank and making efficient use of the energy of the hydraulic fluid generated by the main pump.

Means for Solving the Problem (1) To achieve the above object, the present invention provides a hydraulic drive system for a construction machine including a prime mover, a main pump of the variable displacement type driven by the prime mover, a plurality of actuators driven by hydraulic fluid delivered from the main pump, a plurality of flow control valves that respectively control the flow of the hydraulic fluid supplied from the main pump to the actuators, and a pump control device that performs load sensing control for the delivery flow rate of the main pump so that delivery pressure of the main pump becomes higher than maximum load pressure of the actuators by target differential pressure, comprising: a hydraulic motor arranged in a control hydraulic line connecting a hydraulic fluid supply line for supplying the hydraulic fluid from the main pump to the flow control valves, to a tank, the hydraulic motor being drivable by the hydraulic fluid delivered from the main pump; a generator connected with the rotating shaft of the hydraulic motor; a control device that performs power generation control of the generator so that the delivery pressure of the main pump becomes higher than a target control pressure determined by adding a preset value to the maximum load pressure with the rotation of the hydraulic motor; and an electricity storage device that stores electric power generated by the generator.

By arranging the hydraulic motor, the generator and the control device as above and performing the power generation control of the generator so that the delivery pressure of the main pump becomes higher than the target control pressure (sum of the maximum load pressure and the preset value) due to the rotation of the hydraulic motor, the following effect is achieved. In the neutral state (in which the flow control valves are not operating) and in the actuator driving state, when the delivery pressure of the main pump becomes the preset value or more higher than the maximum load pressure, at least part of the delivery flow of the main pump is returned to the tank by the rotation of the hydraulic motor and unnecessary increase in the delivery pressure of the main pump is avoided. Consequently, the function equivalent to the conventional unload valve is achieved.

Further, when the delivery pressure of the main pump becomes the preset value or more higher than the maximum load pressure, the power generation control is performed on the generator, the energy of the hydraulic fluid is converted into electric energy, and the electric energy is stored in the electricity storage device. This makes it possible to recover the energy of the hydraulic fluid discharged from the main pump to the tank and make efficient use of the energy of the hydraulic fluid generated by the main pump.

(2) Preferably, the above hydraulic drive system (1) for a construction machine further comprising a pressure sensor that detects the maximum load pressure, wherein the control device calculates the target control pressure by adding the preset value to the maximum load pressure detected by the pressure sensor, calculates power generation torque of the generator having magnitude overcoming a rotating torque of the hydraulic motor caused by the target control pressure, and performs the power generation control of the generator so that the power generation torque is achieved.

With this configuration, the control device performs the power generation control of the generator so that the delivery pressure of the main pump becomes higher than the target control pressure (sum of the maximum load pressure and the preset value) due to the rotation of the hydraulic motor.

(3) Preferably, the above hydraulic drive system (1) or (2) for a construction machine further comprises a correction device that corrects the target differential pressure of the load sensing control so that the target differential pressure decreases with the decrease in the revolution speed of the prime mover, wherein the control device corrects the preset value so that the preset value decreases with the decrease in the revolution speed of the prime mover.

With this configuration, the target differential pressure of the load sensing control and the preset value decrease concurrently when the revolution speed of the prime mover is reduced. Therefore, the difference between the target differential pressure of the load sensing control and the preset value does not increase and the stability of the entire system can be secured in the actuator driving state even when the revolution speed of the prime mover is reduced.

(4) Preferably, in any one of the above hydraulic drive systems (1) to (3) for a construction machine, wherein: the prime mover includes an electric motor, and the electricity storage device functions as a power supply for the electric motor.

With this configuration, the energy recovered by the generator can be used for the driving of the electric motor and energy saving of the entire system can be achieved.

Effect of the Invention

According to the present invention, in a hydraulic drive system performing the load sensing control, the function equivalent to that of a hydraulic drive system including the unload valve can be achieved while also recovering the energy of the hydraulic fluid discharged from the main pump to the tank and making efficient use of the energy of the hydraulic fluid generated by the main pump.

MODE FOR CARRYING OUT THE INVENTION

First Embodiment

Configuration

Figure 1:
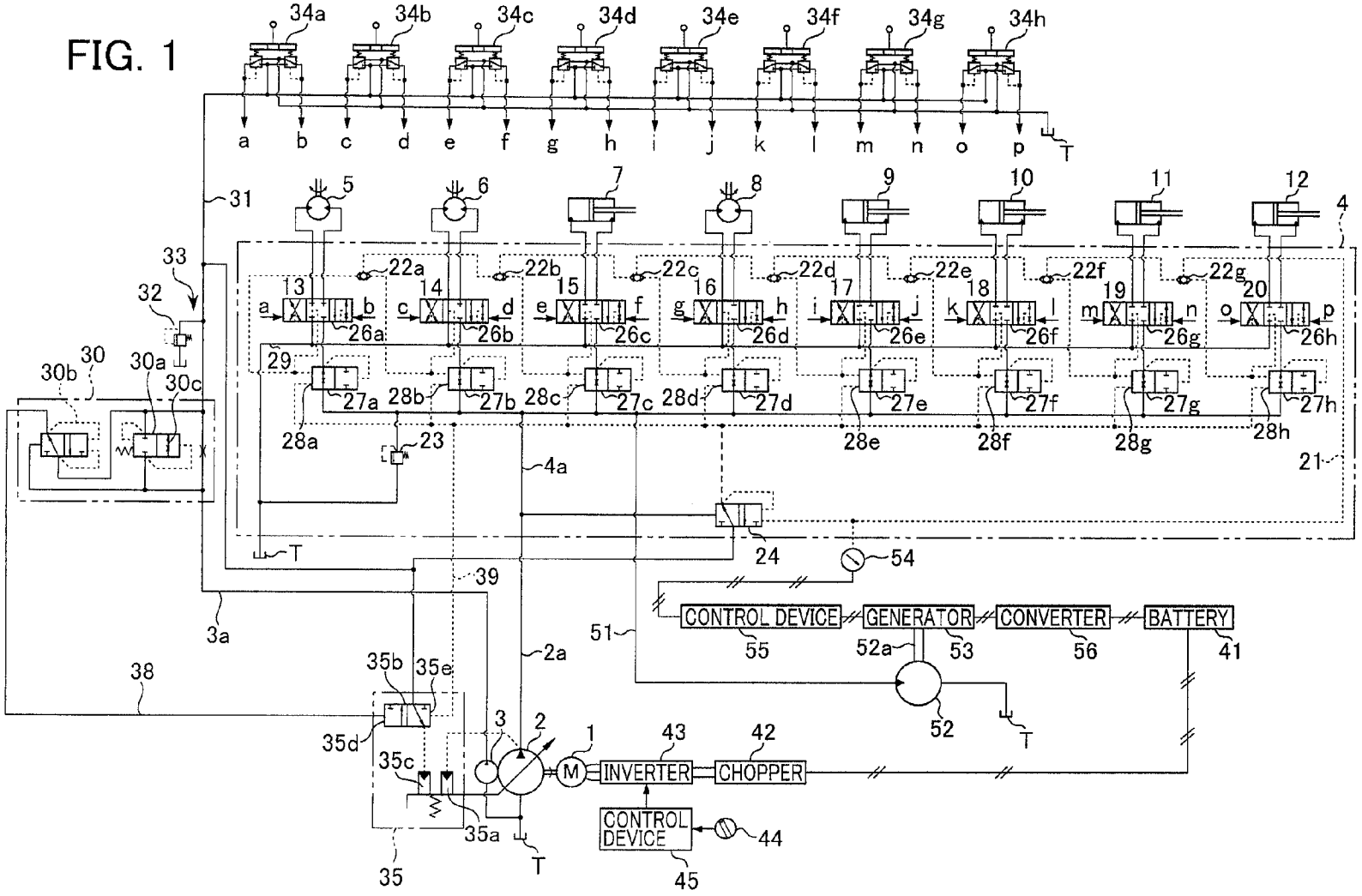
FIG. 1 is a schematic diagram showing a hydraulic drive system for a work machine in accordance with a first embodiment of the present invention.

FIG. 1 is a schematic diagram showing a hydraulic drive system for a work machine in accordance with a first embodiment of the present invention.

The hydraulic drive system in this embodiment comprises an electric motor 1, a main hydraulic pump 2, a pilot pump 3, a plurality of actuators 5, 6, 7, 8, 9, 10, 11 and 12, a control valve 4, an electric motor revolution speed detection valve 30, a pilot hydraulic fluid source 33, and a plurality of control lever devices 34*a*, 34*b*, 34*c*, 34*d*, 34*e*, 34*f*, 34*g* and 34*h*. The main hydraulic pump 2 (hereinafter referred to as a "main pump 2" is driven by the electric motor 1. The pilot pump 3 is driven in conjunction with the main pump 2 by the electric motor 1. The actuators 5, 6, 7, 8, 9, 10, 11 and 12 are driven by hydraulic fluid delivered from the main pump 2. The control valve 4 is arranged between the main pump 2 and the actuators 5, 6, 7, 8, 9, 10, 11 and 12. The electric motor revolution speed detection valve 30 is connected to a hydraulic fluid supply line 3*a* through which hydraulic fluid delivered from the pilot pump 3 is supplied. The pilot hydraulic fluid source 33 is connected downstream of the electric motor revolution speed detection valve 30. The pilot hydraulic fluid source 33 includes a pilot relief valve 32 that maintains the pressure in a pilot line 31 at a constant level. The control lever devices 34*a*, 34*b*, 34*c*, 34*d*, 34*e*, 34*f*, 34*g* and 34*h* are connected to the pilot line 31. The control lever devices 34*a*, 34*b*, 34*c*, 34*d*, 34*e*, 34*f*, 34*g* and 34*h* are respectively including remote control valves for generating control pilot pressures a, b, c, d, e, f, g, h, i, j, k, l, m, n, o and p by using the hydraulic pressure of the pilot hydraulic fluid source 33 as the source pressure.

The work machine of this embodiment is a hydraulic mini-excavator, for example. The actuator 5 is a rotation motor of the hydraulic excavator. The actuators 6 and 8 are left and right travel motors. The actuator 7 is a blade cylinder. The actuator 9 is a swing cylinder. The actuators 10, 11 and 12 are a boom cylinder, an arm cylinder and a bucket cylinder, respectively.

The control valve 4 includes a plurality of valve sections 13, 14, 15, 16, 17, 18, 19 and 20, a plurality of shuttle valves 22*a*, 22*b*, 22*c*, 22*d*, 22*e*, 22*f* and 22*g*, a main relief valve 23, and a differential pressure reducing valve 24. The valve sections 13, 14, 15, 16, 17, 18, 19 and 20 are connected to a first hydraulic fluid supply line (line) 2*a* through which the hydraulic fluid delivered from the main pump 2 is supplied via a second hydraulic fluid supply line (in-block channel) 4*a*. Each of the valve sections 13, 14, 15, 16, 17, 18, 19 and 20 controls the direction and the flow rate of the hydraulic fluid supplied from the main pump 2 to each actuator. The shuttle valves 22*a*, 22*b*, 22*c*, 22*d*, 22*e*, 22*f* and 22*g* select the highest load pressure PLmax from the load pressures of the actuators 5, 6, 7, 8, 9, 10, 11 and 12 (hereinafter referred to as "the maximum load pressure PLmax") and output the maximum load pressure PLmax to a signal hydraulic line 21. The main relief valve 23 is connected to the second hydraulic fluid supply line 4*a* of the control valve 4 and limits the maximum delivery pressure of the main pump 2 (maximum pump pressure). The differential pressure reducing valve 24 is connected to the second hydraulic fluid supply line 4*a* of the control valve 4 and detects and outputs the differential pressure PLS between the delivery pressure Pd of the main pump 2 and the maximum load pressure PLmax as an absolute pressure. The discharging side of the main relief valve 23 is connected to a tank line 29 in the control valve 4. The tank line 29 is connected to a tank T.

The valve section 13 is formed of a flow control valve 26*a* and a pressure compensating valve 27*a*. The valve section 14 is formed of a flow control valve 26*b* and a pressure compensating valve 27*b*. The valve section 15 is formed of a flow control valve 26*c* and a pressure compensating valve 27*c*. The valve section 16 is formed of a flow control valve 26*d* and a pressure compensating valve 27*d*. The valve section 17 is formed of a flow control valve 26*e* and a pressure compensating valve 27*e*. The valve section 18 is formed of a flow control valve 26*f* and a pressure compensating valve 27*f*. The valve section 19 is formed of a flow control valve 26*g* and a pressure compensating valve 27*g*. The valve section 20 is formed of a flow control valve 26*h* and a pressure compensating valve 27*h*.

Each of the flow control valves 26*a* to 26*h* controls the direction and the flow rate of the hydraulic fluid supplied from the main pump 2 to each of the actuators 5 to 12. Each of the pressure compensating valves 27*a* to 27*h* controls the differential pressure across each of the flow control valves 26*a* to 26*h*. The flow control valves 26*a* to 26*h* are operated by the control pilot pressures a, b, c, d, e, f, g, h, i, j, k, l, m, n, o and p generated by the remote control valves of the control lever devices 34*a*, 34*b*, 34*c*, 34*d*, 34*e*, 34*f*, 34*g* and 34*h*, respectively.

Each of the pressure compensating valves 27*a* to 27*h* has a valve-opening pressure receiving part 28*a*, 28*b*, 28*c*, 28*d*, 28*e*, 28*f*, 28*g* and 28*h* for setting a target differential pressure. The output pressure of the differential pressure reducing valve 24 is led to the pressure receiving parts 28*a* to 28*h* and a target compensation differential pressure is set to the pressure receiving parts 28*a* to 28*h* according to the absolute pressure of the differential pressure PLS between the hydraulic pump pressure Pd and the maximum load pressure PLmax. Accordingly, all the differential pressures across the flow control valves 26*a* to 26*h* are controlled to be equal to the differential pressure PLS between the hydraulic pump pressure Pd and the maximum load pressure PLmax. As a result, in the combined operation in which a plurality of actuators are driven at the same time, the delivery flow rate of the main pump 2 can be properly distributed according to the opening area ratio among the flow control valves 26*a* to 26*h* and satisfactory operability in the combined operation can be secured irrespective of the magnitude of the load pressure of each of the actuators 5 to 12. Further, in a saturation state in which the delivery flow rate of the main pump 2 is less than the demanded flow rate, the differential pressure PLS drops according to the degree of the supply deficiency. Accordingly, the differential pressures across the flow control valves 26*a* to 26*h* controlled by the pressure compensating valves 27*a* to 27*h* drop at the same ratio and the flow rates through the flow control valves 26*a* to 26*h* decrease. Also in this case, the delivery flow rate of the main pump 2 can be properly distributed according to the opening area ratio among the flow control valves 26*a* to 26*h* and satisfactory operability in the combined operation can be secured.

The electric motor revolution speed detection valve 30 includes a hydraulic line 30*e* that connects the hydraulic fluid supply line 3*a* (through which the hydraulic fluid delivered from the pilot pump 3 is supplied) to the pilot line 31, a restrictor element (fixed restrictor) 30*f* arranged in the hydraulic line 30*e*, a flow rate detection valve 30*a* connected in parallel with the hydraulic line 30*e* and the restrictor element 30*f*, and a differential pressure reducing valve 30*b*. The flow rate detection valve 30*a* has a variable restrictor part 30*c* that increases its opening area with the increase in the flow rate. The hydraulic fluid delivered from the pilot pump 3 flows into the pilot line 31 through the restrictor element 30*f* of the hydraulic line 30*e* and the variable restrictor part 30*c* of the flow rate detection valve 30*a*. In this case, a differential pressure that increases with the increase in the flow rate of the hydraulic fluid flowing from the hydraulic fluid supply line 3*a* to the pilot line 31 occurs to the restrictor element 30*f* and the variable restrictor part 30*c*. The differential pressure reducing valve 30*b* detects and outputs the differential pressure as an absolute pressure Pa. Since the delivery flow rate of the pilot pump 3 changes according to the revolution speed of the electric motor 1, the delivery flow rate of the pilot pump 3 and the revolution speed of the electric motor 1 can be detected by detecting the differential pressure across the restrictor element 30*f* and the variable restrictor part 30*c*. The variable restrictor part 30*c* is configured so as to reduce the degree of increase of the differential pressure with the increase in the flow rate by increasing the opening area with the increase in the flow rate (with the increase in the differential pressure).

The main pump 2 is a hydraulic pump of the variable displacement type. The main pump 2 is equipped with a pump control device 35 for controlling its tilting angle (displacement). The pump control device 35 includes a horsepower control tilting actuator 35*a*, an LS control valve 35*b* and an LS control tilting actuator 35*c*.

The horsepower control tilting actuator 35*a* limits the input torque of the main pump 2 so as not to exceed preset maximum torque, by reducing the tilting angle of the main pump 2 when the delivery pressure of the main pump 2 becomes high. By this operation, the power consumption of the main pump 2 is limited and the stoppage of the electric motor 1 due to the overload is prevented.

The LS control valve 35*b* has pressure receiving parts 35*d* and 35*e* opposing each other. To the pressure receiving part 35*d*, the absolute pressure Pa (first preset value) outputted from the differential pressure reducing valve 30*b* of the electric motor revolution speed detection valve 30 is led via a hydraulic line 38 as a target differential pressure of the load sensing control (target LS differential pressure). To the pressure receiving part 35*e*, the absolute pressure of the differential pressure PLS outputted from the differential pressure reducing valve 24 is led via a hydraulic line 39 as a feedback pressure. When the absolute pressure of the differential pressure PLS exceeds the absolute pressure Pa (PLS>Pa), the tilting angle of the main pump 2 is decreased by leading the pressure of the pilot hydraulic fluid source 33 to the LS control tilting actuator 35*c*. When the absolute pressure of the differential pressure PLS falls below the absolute pressure Pa (PLS<Pa), the tilting angle of the main pump 2 is increased by connecting the LS control tilting actuator 35*c* to the tank T. By this operation, the tilting level (displacement volume) of the main pump 2 is controlled so that the delivery pressure Pd of the main pump 2 becomes higher than the maximum load pressure PLmax by the absolute pressure Pa (target LS differential pressure). The LS control valve 35*b* and the LS control tilting actuator 35*c* constitute a pump control device of the load sensing type that controls the tilting of the main pump 2 so that the delivery pressure Pd of the main pump 2 becomes higher than the maximum load pressure PLmax of the actuators 5, 6, 7, 8, 9, 10, 11 and 12 by the target differential pressure of the load sensing control (absolute pressure Pa).

Incidentally, since the absolute pressure Pa is a value changing according to the electric motor revolution speed, actuator speed control according to the electric motor revolution speed becomes possible by using the absolute pressure Pa as the target differential pressure of the load sensing control and setting the target compensation differential pressure of the pressure compensating valves 27*a* to 27*h* by using the absolute pressure of the differential pressure PLS between the delivery pressure Pd of the main pump 2 and the maximum load pressure PLmax. Further, since the variable restrictor part 30*c* of the flow rate detection valve 30*a* of the electric motor revolution speed detection valve 30 is configured so as to reduce the degree of increase of the differential pressure with the increase in the flow rate as mentioned above, improvement of the saturation phenomenon depending on the electric motor revolution speed can be made and satisfactory fine-tuning operability can be achieved when the electric motor revolution speed is set low.

The hydraulic drive system of this embodiment comprises a battery 41, a chopper 42, an inverter 43, a revolution control dial 44, a first control device 45, a hydraulic motor 52, a generator 53, a pressure sensor 54, a second control device 55 and a converter 56 as its characteristic configuration. The battery 41 (electricity storage device) serves as the power supply for the electric motor 1. The chopper 42 boosts the voltage of the DC power of the battery 41. The inverter 43 converts the DC power boosted by the chopper 42 into AC power and supplies the AC power to the electric motor 1. The revolution control dial 44 is operated by the operator and indicates a target revolution speed of the electric motor 1. The first control device 45 controls the inverter 43 according to the target revolution speed so that the revolution speed of the electric motor 1 equals the target revolution speed. The hydraulic motor 52 is a hydraulic motor of the fixed displacement type that can be driven by the hydraulic fluid delivered from the main pump 2. The hydraulic motor 52 is arranged in a control hydraulic line 51 connects the second hydraulic fluid supply line 4*a* (supplying the hydraulic fluid delivered from the main pump 2 to the valve sections 13, 14, 15, 16, 17, 18, 19 and 20 (flow control valves 26*a* to 26*h*)) to the tank T. The generator 53 connected with the rotating shaft 52*a* of the hydraulic motor 52. The pressure sensor 54 is connected to the signal hydraulic line 21 and detects the maximum load pressure PLmax. The second control device 55 controls the power generation performed by the generator 53 so that the hydraulic motor 52 rotates when the delivery pressure of the main pump 2 is higher than a target control pressure Pun (the sum of the maximum load pressure PLmax and a preset value Pb). The converter 56 converts AC power generated by the generator 53 into DC power. The battery 41 is a battery of the rechargeable type. The DC power acquired by converting by the converter 56 the AC power generated by the generator 53 is stored in the battery 41. The control hydraulic line 51, in which the hydraulic motor 52 is arranged, may also be connected to the first hydraulic fluid supply line 2*a* through which the hydraulic fluid delivered from the main pump 2 is supplied.

Figure 2:
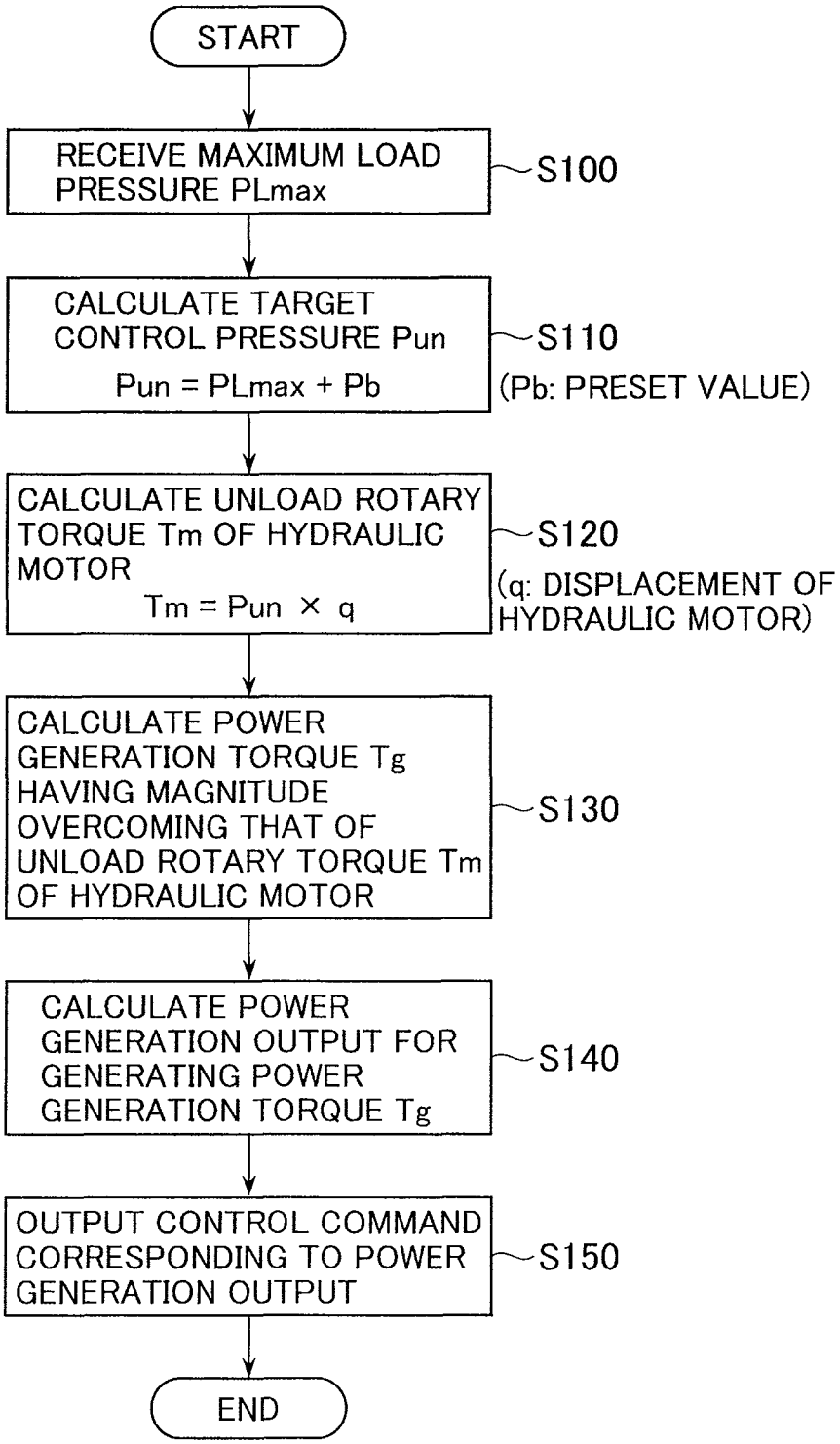
FIG. 2 is a flow chart showing a process executed by a second control device.

FIG. 2 is a flow chart showing a process executed by the second control device 55.

<Step S100>

The second control device 55 receives a signal representing the maximum load pressure PLmax detected by the pressure sensor 54.

<Step S110>

Subsequently, the second control device 55 calculates the target control pressure Pun by adding the preset value Pb to the maximum load pressure PLmax.

That is, $Pun=PL\max+Pb$

The preset value Pb is set to be equal to or slightly higher than the absolute pressure Pa (target LS differential pressure) outputted from the differential pressure reducing valve 30*b*, for example. Assuming that the absolute pressure Pa (target LS differential pressure) outputted from the differential pressure reducing valve 30*b* equals 2.0 MPa when the electric motor 1 is revolving at its maximum rated revolution speed, the preset value Pb is set at approximately 2.0 to 3.0 MPa, for example. In this embodiment, the preset value Pb has been set equal to the absolute pressure Pa (target LS differential pressure). Incidentally, the preset value Pb may also be set lower than the absolute pressure Pa (target LS differential pressure) in consideration of factors like a revolution delay due to the inertia of the hydraulic motor 52 and the generator 53.

<Step S120>

Subsequently, the second control device 55 calculates rotary torque Tm that acts on the hydraulic motor 52 when the delivery pressure of the main pump 2 has reached the target control pressure Pun. This rotary torque Tm can be calculated according to the following expression (q: displacement of the hydraulic motor 52):

$$Tm=Pun\times q$$

In this description, the rotary torque is referred to as unload rotary torque.

<Step S130>

Subsequently, the second control device 55 calculates power generation torque Tg having magnitude overcoming that of the unload rotary torque Tm of the hydraulic motor 52. The power generation torque Tg having magnitude overcoming that of the unload rotary torque Tm of the hydraulic motor 52 means rotary torque whose magnitude is equal to or slightly higher than that of the unload rotary torque Tm and whose rotational direction is opposite to that of the unload rotary torque Tm.

<Step S140>

Subsequently, the second control device 55 calculates power generation output necessary for the generation of the power generation torque Tg by the generator 53.

<Step S150>

Subsequently, the second control device 55 outputs a control command corresponding to the power generation output to the generator 53 and thereby makes the generator 53 generate the power generation torque Tg having magnitude overcoming that of the unload rotary torque Tm of the hydraulic motor 52.

The above control of the generator 53 allows the hydraulic motor 52, the generator 53, the pressure sensor 54 and the second control device 55 to achieve the function equivalent to the conventional unload valve, that is, controlling the delivery pressure of the main pump 2 so that it does not exceed the sum of the maximum load pressure PLmax and a target unload pressure (the preset value Pb) by returning the delivery flow of the main pump 2 to the tank T when the delivery pressure of the main pump 2 exceeds the sum (i.e., the target control pressure Pun).

(Hydraulic Excavator)

Figure 3:
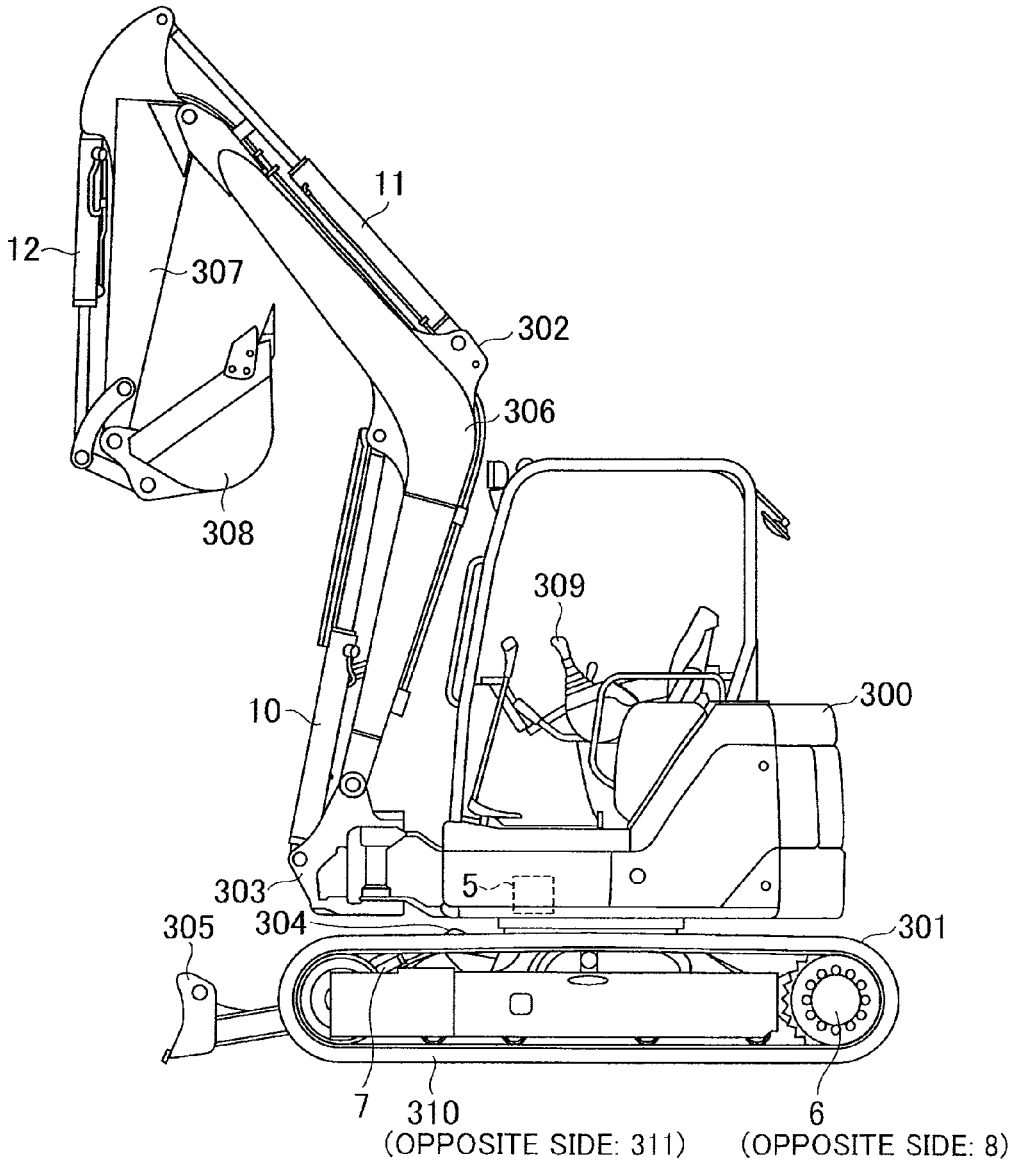
FIG. 3 is a schematic diagram showing the external appearance of a hydraulic excavator.

FIG. 3 shows the external appearance of the hydraulic excavator.

Referring to FIG. 3, the hydraulic excavator (well known as a type of the work machine) comprises an upper rotating structure 300, a lower travel structure 301, and a front work implement 302 of the swinging type. The front work implement 302 is made up of a boom 306, an arm 307 and a bucket 308. The upper rotating structure 300 is capable of rotating the lower travel structure 301 by the rotation of the rotation motor 5 shown in FIG. 1. A swing post 303 is attached to the front part of the upper rotating structure 300. The front work implement 302 is attached to the swing post 303 to be movable up and down. The swing post 303 can be swung with respect to the upper rotating structure 300 by the expansion/contraction of the swing cylinder 9 shown in FIG. 1. The boom 306, the arm 307 and the bucket 308 of the front work implement 302 can be vertically rotated by the expansion/contraction of the boom cylinder 10, the arm cylinder 11 and the bucket cylinder 12 shown in FIG. 1. The lower travel structure 301 has a center frame 304. A blade 305 that is moved up and down by the expansion/contraction of the blade cylinder 7 shown in FIG. 1 is attached to the center frame 304. The lower travel structure 301 travels by driving left and right crawlers 310 and 311 by the rotation of the travel motors 6 and 8 shown in FIG. 1.

(Operation)

Next, the operation of the hydraulic drive system of this embodiment will be described below.

<When all Control Levers are at Neutral Positions>

When the control levers of all the control lever devices 34*a* to 34*h* are at their neutral positions, all the flow control valves 26*a* to 26*h* are at their neutral positions and no hydraulic fluid is supplied to the actuators 5 to 12. When the flow control valves 26*a* to 26*h* are at the neutral positions, the maximum load pressure PLmax detected by the shuttle valves 22*a* to 22*g* equals the tank pressure (approximately 0 MPa).

The differential pressure reducing valve 24 outputs the differential pressure PLS between the delivery pressure Pd of the main pump 2 and the maximum load pressure PLmax (the tank pressure in this case) as absolute pressure. The absolute pressure of the differential pressure PLS (output pressure of the differential pressure reducing valve 24) and the absolute pressure Pa (output pressure of the electric motor revolution speed detection valve 30) are led to the LS control valve 35*b* of the pump control device 35 of the main pump 2. When the delivery pressure of the main pump 2 increases and the absolute pressure of the differential pressure PLS exceeds the absolute pressure Pa, the LS control valve 35*b* is switched to the right-hand position in FIG. 1, by which the pressure of the pilot hydraulic fluid source 33 is led to the LS control tilting actuator 35*c* to reduce the tilting angle of the main pump 2. However, the main pump 2, having a stopper (unshown) specifying its minimum tilting angle, is held at the minimum tilting angle qmin specified by the stopper and delivers its minimum flow rate Qmin.

Further, since the maximum load pressure PLmax substantially equals the tank pressure (0 MPa), the target control pressure Pun calculated by the second control device 55 substantially equals the preset value Pb (Pun=Pb) and the generator 53 is controlled so as to generate the power generation torque Tg having magnitude overcoming that of the unload rotary torque Tm corresponding to the target control pressure Pun (power generation torque whose magnitude is equal to or slightly higher than that of the unload rotary torque Tm and whose rotational direction is opposite to that of the unload rotary torque Tm). As a result, when the delivery pressure of the main pump 2 exceeds the preset value Pb, the rotary torque acting on the hydraulic motor 52 exceeds the power generation torque of the generator 53. Accordingly, the hydraulic motor 52 rotates (is driven), the hydraulic fluid delivered from the main pump 2 flows into the tank T via the hydraulic motor 52, and the delivery pressure of the main pump 2 is controlled so as not to exceed the preset value Pb. In this case, the hydraulic motor 52 is driven by the hydraulic fluid delivered from the main pump 2, the generator 53 is driven by the hydraulic motor 52 and generates electric energy, and the generated electric energy is stored in the battery 41 via the converter 56.

<When Control Lever is Operated>

This explanation will be given by taking the operation on the boom cylinder 10 as an example. When the operator intending the boom raising operation operates the control lever of the boom control lever device 34*f* leftward in FIG. 1 (in a boom raising direction) to a full-stroke position, a control pilot pressure k for operating the flow control valve 26*f* is generated based on the hydraulic fluid from the pilot hydraulic fluid source 33 and is led to the flow control valve 26*f*. Accordingly, the flow control valve 26*f* for the boom is switched, the hydraulic fluid is supplied to the boom cylinder 10, and the boom cylinder 10 is driven.

The flow rate through the flow control valve 26*f* is determined by the opening area of the meter-in restrictor of the flow control valve 26*f* and the differential pressure across the meter-in restrictor. Since the differential pressure across the meter-in restrictor is controlled by the pressure compensating valve 27*f* to be equal to the absolute pressure of the differential pressure PLS (output pressure of the differential pressure reducing valve 24), the flow rate through the flow control valve 26*f* (i.e., driving speed of the boom cylinder 10) is controlled according to the operation amount of the control lever.

When the boom cylinder 10 starts moving, the pressure in the first and second hydraulic fluid supply lines 2*a* and 4*a* drops temporarily. At this time, the load pressure of the boom cylinder 10 is detected by the shuttle valves 22*a* to 22*g* as the maximum load pressure and the difference between the pressure in the first and second hydraulic fluid supply lines 2*a* and 4*a* and the load pressure of the boom cylinder 10 is outputted as the output pressure of the differential pressure reducing valve 24. Consequently, the absolute pressure of the differential pressure PLS outputted from the differential pressure reducing valve 24 drops.

The LS control valve 35*b* of the pump control device 35 of the main pump 2 is supplied with the absolute pressure Pa outputted from the differential pressure reducing valve 30*b* of the electric motor revolution speed detection valve 30 and the absolute pressure of the differential pressure PLS outputted from the differential pressure reducing valve 24. When the absolute pressure of the differential pressure PLS falls below the absolute pressure Pa, the LS control valve 35*b* is switched to the left-hand position in FIG. 1, the LS control tilting actuator 35*c* is connected to the tank T to return the hydraulic fluid of the LS control tilting actuator 35*c* to the tank, the tilting angle of the main pump 2 is increased, and the delivery flow rate of the main pump 2 is increased. The increase of the delivery flow rate of the main pump 2 continues until the absolute pressure of the differential pressure PLS becomes equal to the absolute pressure Pa. By the above sequence of operations, the delivery pressure of the main pump 2 (the pressure in the first and second hydraulic fluid supply lines 2*a* and 4*a*) is controlled to becomes a pressure higher by the absolute pressure Pa outputted from the electric motor revolution speed detection valve 30 than the maximum load pressure PLmax and the so-called load sensing control for supplying the flow rate demanded by the boom flow control valve 26*f* to the boom cylinder 10 is carried out.

When the delivery pressure Pd of the main pump 2 exceeds the target control pressure Pun (the sum of the maximum load pressure PLmax and the preset value Pb) during this operation, the hydraulic motor 52 rotates (is driven) since the generator 53 is controlled by the second control device 55 to generate the power generation torque Tg having magnitude overcoming that of the unload rotary torque Tm occurring in the hydraulic motor 52 due to the target control pressure Pun (Pun=PLmax+Pb). Accordingly, part of the hydraulic fluid delivered from the main pump 2 is discharged to the tank T via the hydraulic motor 52 and the delivery pressure of the main pump 2 is controlled so as not to exceed the target control pressure Pun (the sum of the maximum load pressure PLmax and the preset value Pb). In this case, the hydraulic motor 52 is driven by the hydraulic fluid delivered from the main pump 2, the generator 53 is driven by the hydraulic motor 52 and generates electric energy, and the generated electric energy is stored in the battery 41 via the converter 56.

The operation when a different control lever other than the above control lever for the boom is operated alone is equivalent to the above-described operation.

When control levers of control lever devices for two or more actuators (e.g., the control levers of the boom control lever device 34*f* and the arm control lever device 34*g*) are operated, the flow control valves 26*f* and 26*g* are switched and the hydraulic fluid is supplied to the boom cylinder 10 and the arm cylinder 11 to drive the boom cylinder 10 and the arm cylinder 11.

The higher one of the load pressures of the boom cylinder 10 and the arm cylinder 11 is detected by the shuttle valves 22*a* to 22*g* as the maximum load pressure PLmax and is transmitted to the differential pressure reducing valve 24.

The LS control valve 35*b* of the pump control device 35 of the main pump 2 is supplied with the absolute pressure Pa outputted from the electric motor revolution speed detection valve 30 and the absolute pressure of the differential pressure PLS outputted from the differential pressure reducing valve 24. Similarly to the case where the boom cylinder 10 is driven alone, the delivery pressure of the main pump 2 (the pressure in the first and second hydraulic fluid supply lines 2*a* and 4*a*) is controlled to becomes a pressure higher by the absolute pressure Pa (the target LS differential pressure) than the maximum load pressure PLmax and the so-called load sensing control for supplying the flow rate demanded by the flow control valves 26*f* and 26*g* to the boom cylinder 10 and the arm cylinder 11 is carried out.

The output pressure of the differential pressure reducing valve 24 is led to the pressure compensating valves 27*a* to 27*h* as the target compensation differential pressure. The pressure compensating valves 27*f* and 27*g* perform control so that the differential pressure across the flow control valve 26*f* and the differential pressure across the flow control valve 26*g* equal the differential pressure between the delivery pressure of the main pump 2 and the maximum load pressure PLmax. This makes it possible to supply the hydraulic fluid to the boom cylinder 10 and the arm cylinder 11 according to the ratio between the opening areas of the meter-in restrictor parts of the flow control valves 26*f* and 26*g* irrespective of the magnitude of the load pressures of the boom cylinder 10 and the arm cylinder 11.

In this case, when the delivery flow rate of the main pump 2 falls below the flow rate demanded by the flow control valves 26*f* and 26*g* (saturation state), the output pressure of the differential pressure reducing valve 24 (the differential pressure between the delivery pressure of the main pump 2 and the maximum load pressure PLmax) drops according to the degree of the saturation. Since the target compensation differential pressure of the pressure compensating valves 27*a* to 27*h* also drops accordingly, the delivery flow rate of the main pump 2 can be redistributed properly at the ratio between the flow rates demanded by the flow control valves 26*f* and 26*g*.

Also when the delivery pressure Pd of the main pump 2 exceeds the target control pressure Pun (the sum of the maximum load pressure PLmax and the preset value Pb) during this operation, the control of the generator 53 is performed by the second control device 55. Accordingly, part of the hydraulic fluid delivered from the main pump 2 is discharged to the tank T via the hydraulic motor 52, the delivery pressure of the main pump 2 is controlled so as not to exceed the target control pressure Pun (the sum of the maximum load pressure PLmax and the preset value Pb), the generator 53 is driven by the hydraulic motor 52 and generates electric energy, and the generated electric energy is stored in the battery 41 via the converter 56.

The operation when different control levers (other than the above control levers for the boom and the arm) are operated at the same time is equivalent to the above-described operation.

<When Control Lever is Returned to Neutral Position>

This explanation will be given by taking the operation on the boom cylinder 10 as an example. When the operator intending to stop the boom raising operation returns the control lever of the boom control lever device 34*f* from the full-stroke position to the neutral position, the hydraulic fluid from the pilot hydraulic fluid source 33 is blocked, the generation of the control pilot pressure k for operating the flow control valve 26*f* stops, and the flow control valve 26*f* returns to its neutral position. The hydraulic fluid delivered from the main pump 2 is stopped from flowing into the boom cylinder 10 since the flow control valve 26*f* has returned to the neutral position.

At this time, the delivery pressure Pd of the main pump 2 increases temporarily. However, when the delivery pressure Pd of the main pump 2 exceeds the target control pressure Pun (the sum of the maximum load pressure PLmax and the preset value Pb), part of the hydraulic fluid delivered from the main pump 2 is discharged to the tank T via the hydraulic motor 52 by the control of the generator 53 by the second control device 55, by which the delivery pressure of the main pump 2 is controlled so as not to exceed the target control pressure Pun (the sum of the maximum load pressure PLmax and the preset value Pb). Also in this case, the generator 53 is driven by the hydraulic motor 52 and generates electric energy. The generated electric energy is stored in the battery 41 via the converter 56.

After the control lever of the control lever device 34*f* is returned to its neutral position, the control levers of all the control lever devices 34*a* to 34*h* are situated at their neutral positions. Thus, as explained in <When All Control Levers are at Neutral Positions>, the main pump 2 is controlled to reduce its tilting angle and is held at the minimum tilting angle qmin to deliver the minimum flow rate Qmin.

<When Electric Motor Revolution Speed is Reduced>

The operation described above is the operation at times when the electric motor 1 is rotating at its maximum rated revolution speed. When the revolution speed of the electric motor 1 is reduced to a lower speed, the absolute pressure Pa outputted from the electric motor revolution speed detection valve 30 drops correspondingly and thus the target LS differential pressure of the LS control valve 35*b* of the pump control device 35 also drops similarly. Further, the target compensation differential pressure of the pressure compensating valves 27*a* to 27*h* also drops similarly as a result of the load sensing control. Accordingly, with the reduction in the engine revolution speed, the delivery flow rate of the main pump 2 and the demanded flow rate of the flow control valves 26*a* to 26*h* decrease. Consequently, the driving speeds of the actuators 5 to 12 are prevented from increasing too much and the fine-tuning operability when the engine revolution speed is reduced can be improved.

(Effect)

As described above, in this embodiment, when all the control levers are at the neutral positions (when the flow control valves 26*a* to 26*h* are not operating) and when a control lever is operated (when corresponding one of the actuators 5 to 12 is driven), the generator 53 does not rotate (nor does the hydraulic motor 52) until the delivery pressure of the main pump 2 becomes more higher than the sum of the preset value Pb and the maximum load pressure PLmax. Therefore, the delivery flow from the main pump 2 is prevented from being wastefully returned to the tank. In contrast, when the delivery pressure of the main pump 2 becomes more higher than the sum of the preset value Pb and the maximum load pressure PLmax, the generator 53 rotates and the hydraulic motor 52 also rotates. Thus, at least part of the delivery flow from the main pump 2 is returned to the tank and unnecessary increase in the delivery pressure of the main pump 2 is prevented. Consequently, the function equivalent to the conventional unload valve is achieved.

Further, since the generator 53 rotates when the delivery pressure of the main pump 2 has become more higher than the sum of the preset value Pb and the maximum load pressure PLmax, the energy of the hydraulic fluid is converted into electric energy and stored in the battery 41. This makes it possible to recover the energy of the hydraulic fluid discharged from the main pump 2 to the tank and make efficient use of the energy of the hydraulic fluid generated by the main pump 2.

As described above, according to this embodiment, a hydraulic drive system performing the load sensing control is enabled to achieve the function equivalent to that of a hydraulic drive system including an unload valve while also recovering the energy of the hydraulic fluid discharged from the main pump 2 to the tank and making efficient use of the energy of the hydraulic fluid generated by the main pump 2.

Further, since the prime mover for driving the main pump 2 is implemented by the electric motor 1 and the electric motor 1 is driven by using the battery 41 (electricity storage device) as the power supply in this embodiment, the energy recovered by the generator 53 can be used for driving the electric motor 1 and energy saving of the entire system can be achieved.

Second Embodiment

A second embodiment of the present invention will be described below referring to FIGS. 4 and 5. In this embodiment, the target unload pressure (preset value Pb) is made variable corresponding to the target revolution speed of the electric motor indicated by the revolution control dial 44.

Figure 4:
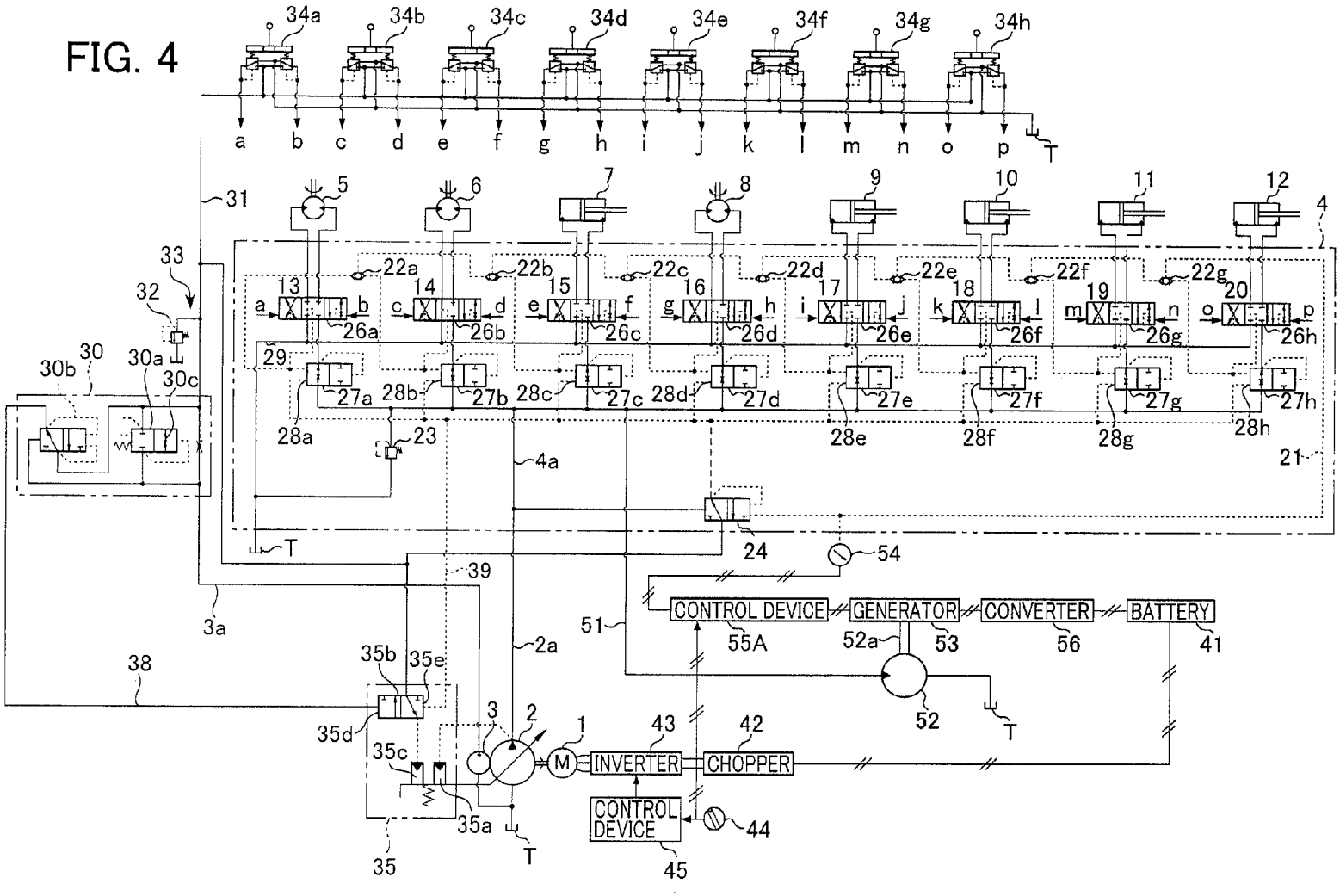
FIG. 4 is a schematic diagram showing a hydraulic drive system for a work machine in accordance with a second embodiment of the present invention.

FIG. 4 is a schematic diagram showing a hydraulic drive system for a work machine in accordance with the second embodiment of the present invention.

In the hydraulic drive system for a work machine in accordance with this embodiment, an indication signal representing the target revolution speed of the electric motor 1 indicated by the revolution control dial 44 is inputted to a second control device 55A.

Figure 5:
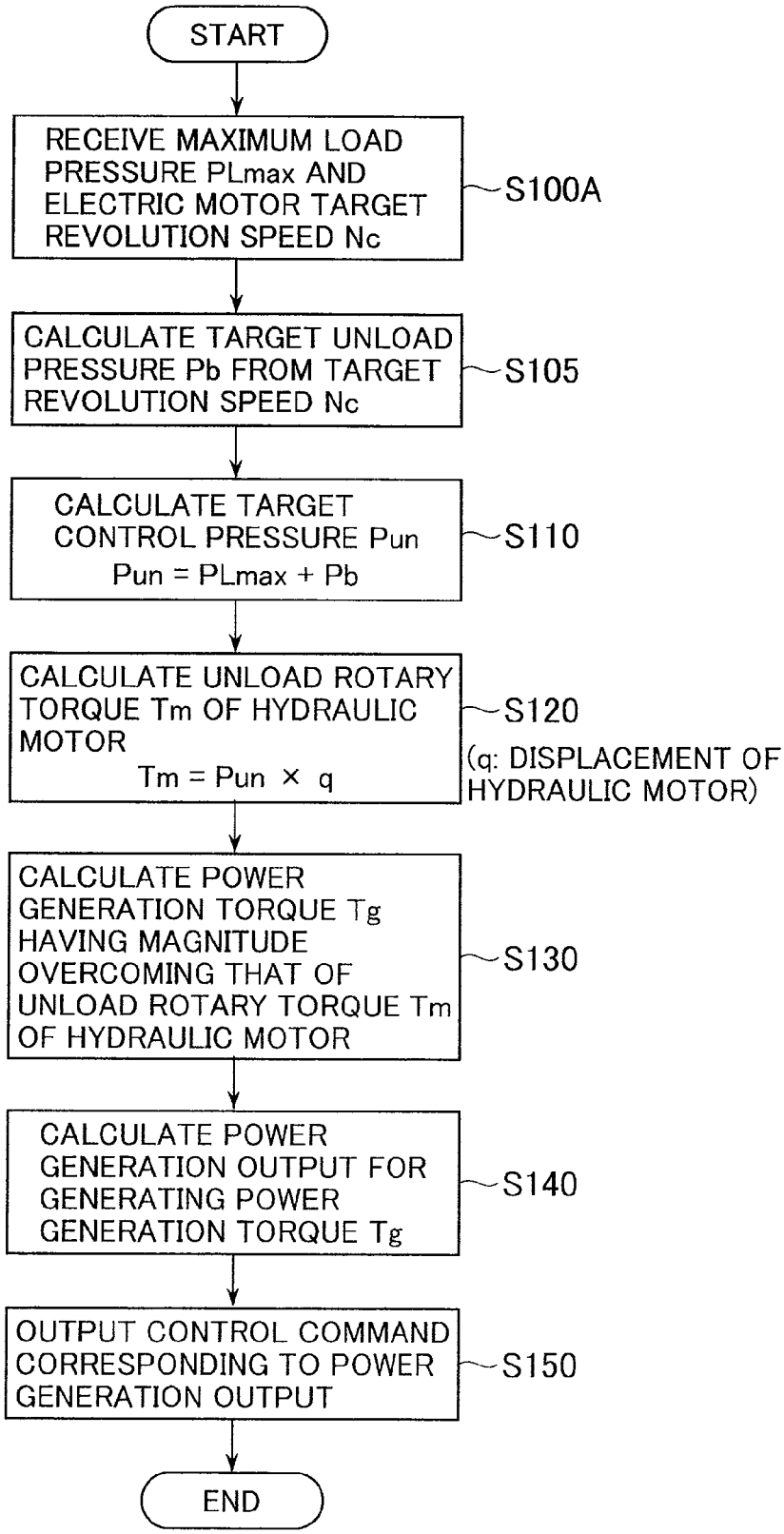
FIG. 5 is a flow chart showing a process executed by a second control device in the second embodiment.

FIG. 5 is a flow chart showing a process executed by the second control device 55A.

<Step S100A>

The second control device 55A receives signals representing the maximum load pressure PLmax detected by the pressure sensor 54 and the target revolution speed Nc of the electric motor 1 indicated by the revolution control dial 44.

<Step S105>

Subsequently, the second control device 55A calculates a target unload pressure Pb corresponding to the target revolution speed Nc of the electric motor 1 by referring to a table stored in a memory by use of the target revolution speed Nc.

Figure 6:
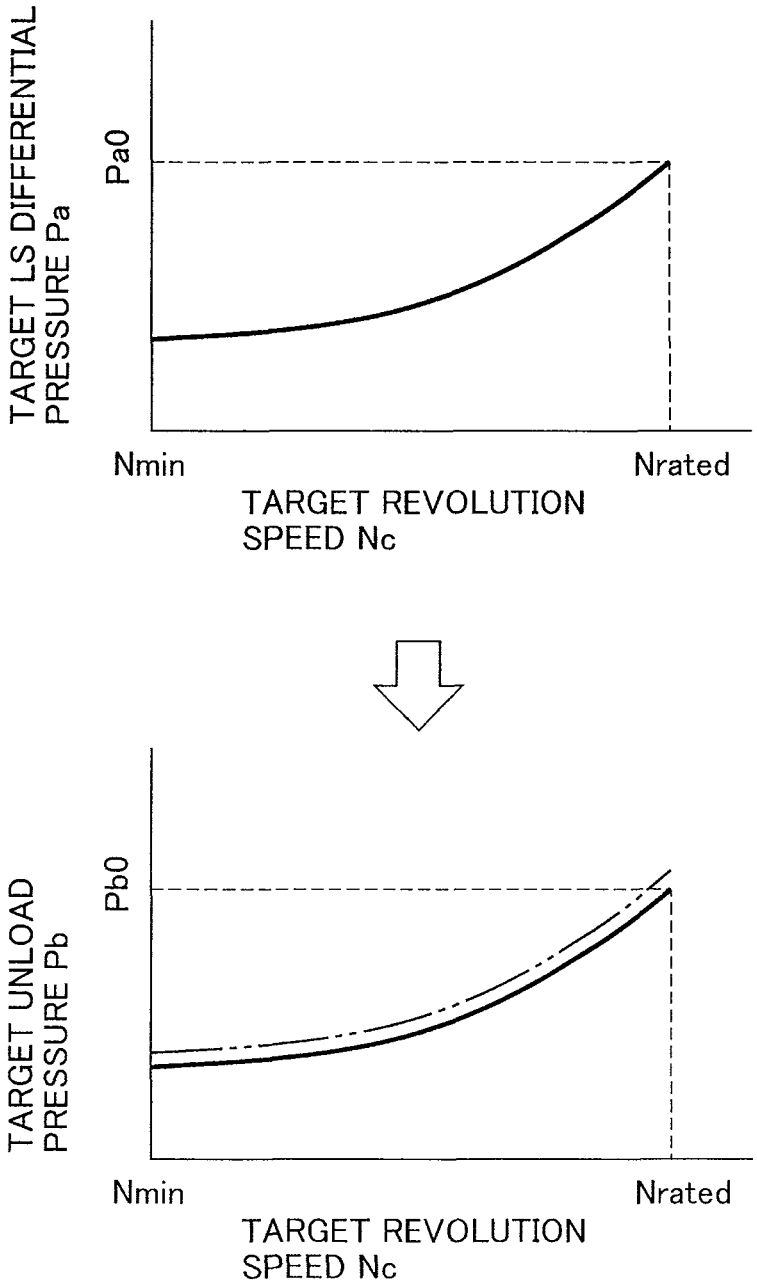
FIG. 6 is a schematic diagram showing the relationship between target revolution speed Nc and target unload pressure Pb stored in a table in a memory.

FIG. 6 is a schematic diagram showing the relationship between the target revolution speed Nc and the target unload pressure Pb stored in the table in the memory. When the target revolution speed Nc of the electric motor 1 is reduced by operating the revolution control dial 44, the absolute pressure Pa (target LS differential pressure) outputted from the differential pressure reducing valve 30*b* of the electric motor revolution speed detection valve 30 decreases in a curved manner with the decrease in the target revolution speed Nc as shown in the upper part of FIG. 6. The relationship between the target revolution speed Nc of the electric motor 1 and the target unload pressure Pb has been set similarly to the relationship between the target revolution speed Nc and the target LS differential pressure Pa so that the target unload pressure Pb decreases in a curved manner with the decrease in the target revolution speed Nc as shown in the lower part of FIG. 6 when the target revolution speed Nc is reduced by operating the revolution control dial 44. In this example, the relationship between the target revolution speed Nc and the target unload pressure Pb has been set identically to the relationship between the target revolution speed Nc and the target LS differential pressure Pa, for example. In this case, the target unload pressure Pb0 when the target revolution speed Nc of the electric motor 1 is at the maximum rated revolution speed Nrated is equal to the target LS differential pressure Pa0 when the target revolution speed Nc of the electric motor 1 is at the maximum rated revolution speed Nrated. Assuming that the target LS differential pressure Pa0 is 2.0 MPa, for example, the target unload pressure Pb0 equals 2.0 MPa. Incidentally, the relationship between the target revolution speed Nc and the target unload pressure Pb may also be set so that the target unload pressure Pb becomes slightly higher than the target LS differential pressure Pa as indicated by the two-dot chain line in the lower part of FIG. 6.

<Steps S110 to S150>

The subsequent steps executed by the second control device 55A are identical with those in the first embodiment shown in FIG. 2.

In this embodiment configured as above, when the target revolution speed Nc of the electric motor 1 indicated by the revolution control dial 44 equals the maximum rated revolution speed Nrated, the target unload pressure Pb0=Pa0 is calculated. The target unload pressure Pb0 equals the preset value Pb in the first embodiment. Thus, in this case, the hydraulic motor 52 and the generator 53 operate in the same way as in the first embodiment, achieving effects equivalent to those of the first embodiment.

When the operator intending a fine-tuning operation (e.g., horizontal tow) reduces the target revolution speed Nc of the electric motor 1 from the maximum rated revolution speed Nrated by operating the revolution control dial 44, the target unload pressure Pb also decreases from the absolute pressure Pb0 in response to the reduction in the target revolution speed Nc of the electric motor 1. The target control pressure Pun (the sum of the maximum load pressure PLmax and the target unload pressure Pb) also decreases in a similar manner. When all the control levers are at the neutral positions (when the flow control valves 26*a* to 26*h* are not operating) and when a control lever is operated (when corresponding one of the actuators 5 to 12 is driven), if the delivery pressure of the main pump 2 exceeds the target control pressure Pun, the hydraulic motor 52 rotates, at least part of the delivery flow of the main pump 2 is returned to the tank, and unnecessary increase in the delivery pressure of the main pump 2 is prevented. Further, the generator 53 is driven by the hydraulic motor 52 and generates electric energy. The generated electric energy is stored in the battery 41 via the converter 56.

Thus, also in this case, the function equivalent to the unload valve can be achieved while also recovering the energy of the hydraulic fluid discharged from the main pump 2 to the tank and making efficient use of the energy of the hydraulic fluid generated by the main pump 2.

Further, when the target revolution speed Nc of the electric motor 1 is reduced by operating the revolution control dial 44, the absolute pressure Pa (target LS differential pressure) outputted from the differential pressure reducing valve 30*b* of the electric motor revolution speed detection valve 30 decreases and the target control pressure Pun (the sum of the maximum load pressure PLmax and the target unload pressure Pb) also decreases in a similar manner. Therefore, the difference between the target LS differential pressure and the target control pressure Pun does not increase and the system stability in the driving of actuators 5 to 12 can be secured even when the revolution speed of the electric motor 1 is reduced.

Specifically, when the maximum load pressure PLmax fluctuates in the driving of an actuator due to the fluctuation in the workload, the tilting angle of the main pump 2 is changed accordingly by the control of the LS control valve 35*b* (load sensing control) and the delivery pressure of the main pump 2 is adjusted. However, there are cases where the main pump 2 delivers the hydraulic fluid at a flow rate greater than the flow rate demanded by the actuator due to a delay in the control of the LS control valve 35*b*. If the target control pressure Pun is constant in this case, the increase in the delivery flow rate of the main pump 2 due to the delay in the control of the LS control valve 35*b* causes an increase in the delivery pressure of the main pump 2 in spite of the reduction of the target revolution speed Nc of the electric motor 1 by operating the revolution control dial 44. Accordingly, the absolute pressure of the differential pressure PLS outputted from the differential pressure reducing valve 24 increases significantly relative to the target LS differential pressure and this can cause oscillation of the entire system.

In contrast, in this embodiment, when the target revolution speed Nc of the electric motor 1 is reduced by operating the revolution control dial 44, the target control pressure Pun decreases accordingly and the difference between the target LS differential pressure and the target control pressure Pun does not increase. Thus, when the delivery pressure of the main pump 2 exceeds the target control pressure Pun that substantially equal to the target LS differential pressure, the hydraulic motor 52 rotates immediately and discharges part of the delivery flow of the main pump 2 to the tank. By this operation, a certain amount of hydraulic fluid corresponding to the flow rate caused by the delay in the tilting of the main pump 2 is discharged and the stability of the entire system is secured.

Other Examples

The above embodiments can be modified in a variety of ways within the spirit and scope of the present invention. For example, while the electric motor 1 is employed as the prime mover in the above embodiments, the prime mover may also be implemented by a diesel engine. In this case, the electric power stored in the battery 41 may be used as the power source for the electric components. The prime mover may also be implemented by a combination of a diesel engine and an electric motor. In this case, it is possible to use the electric power of the battery 41 for assisting the driving of the electric motor when the actuator load is high, and to operate the electric motor as the generator and store the generated electric power in the battery 41 when the engine has excess power, by which downsizing of the engine and further energy saving can be achieved.

In the above embodiments, the detection of the revolution speed of the electric motor 1 is made in the hydraulic manner by using the electric motor revolution speed detection valve 30 and the setting of the target LS differential pressure by use of the revolution speed signal of the electric motor 1 (the absolute pressure Pa outputted from the differential pressure reducing valve 30*b*) is made in the hydraulic manner by using the LS control valve 35*b*. However, the load sensing control may also be carried out in an electric manner by providing a revolution sensor for detecting the revolution speed of the electric motor 1 or the main pump 2, calculating the target differential pressure based on the signal from the sensor, and controlling a solenoid valve accordingly.

While the output pressure of the differential pressure reducing valve 24 is led to the pressure compensating valves 27*a* to 27*h* and the LS control valve 35*b* as the differential pressure PLS between the delivery pressure of the main pump 2 and the maximum load pressure PLmax in the above embodiments, it is also possible to separately lead the delivery pressure of the main pump 2 and the maximum load pressure PLmax to the pressure compensating valves 27*a* to 27*h* and the LS control valve 35*b*.

While the power generation control of the generator 53 in the above embodiments is performed so that the hydraulic motor 52 does not rotate until the delivery pressure of the main pump 2 exceeds the target control pressure Pun (the sum of the maximum load pressure PLmax and the preset value Pb), the hydraulic motor 52 may be rotated even when the delivery pressure of the main pump 2 is not higher than the target control pressure Pun (the sum of the maximum load pressure PLmax and the preset value Pb) if the revolution speed is low. This allows the hydraulic motor 52 and the generator 53 to rotate with no response delay when the delivery pressure of the main pump 2 exceeds the target control pressure Pun (the sum of the maximum load pressure PLmax and the preset value Pb) and enables control that suppresses the transient increase in the delivery pressure of the main pump 2. Further, the constant flow of the hydraulic fluid into the hydraulic motor 52 achieves effects such as constant and appropriate lubrication of the hydraulic motor 52 and a long operating life of the hydraulic motor 52.

While the above embodiments have been described by taking a hydraulic excavator as an example of the construction machine, the present invention is applicable also to other types of construction machines (hydraulic cranes, wheel excavators, etc.) in similar ways and effects equivalent to be above-described effects can be achieved.

DESCRIPTION OF REFERENCE CHARACTERS

1 Electric motor
2 Main pump
2*a* First hydraulic fluid supply line
3 Pilot pump
3*a* Hydraulic fluid supply line
4 Control valve
4*a* Second hydraulic fluid supply line
5 to 12 Actuator
13 to 20 Valve section
21 Signal hydraulic line
22*a* to 22*g* Shuttle valve
23 Main relief valve
24 Differential pressure reducing valve
26*a* to 26*h* Flow control valve (main spool)
27*a* to 27*h* Pressure compensating valve
30 Electric motor revolution speed detection valve
30*a* Flow rate detection valve
30*b* Differential pressure reducing valve
30*c* Variable restrictor part
31 Pilot line
32 Pilot relief valve
33 Pilot hydraulic fluid source
34*a* to 34*h* Control lever device
35 Pump control device
35*a* Horsepower control tilting actuator
35*b* LS control valve
35*c* LS control tilting actuator
35*d*, 35*e* Pressure receiving part
38, 39 Hydraulic line
41 Battery
42 Chopper
43 Inverter
44 Revolution control dial
45 First control device
51 Control hydraulic line
52 Hydraulic motor
52*a* Rotating shaft
53 Generator
54 Pressure sensor
55 Second control device
56 Converter
300 Upper rotating structure
301 Lower travel structure
302 Front work implement
303 Swing post
304 Center frame
305 Blade
306 Boom
307 Arm
308 Bucket
310, 311 Crawler

The invention claimed is:

1. A hydraulic drive system for a construction machine including a prime mover, a main pump of the variable displacement type driven by the prime mover, a plurality of actuators driven by hydraulic fluid delivered from the main pump, a plurality of flow control valves that respectively control the flow of the hydraulic fluid supplied from the main pump to the actuators, and a pump control device that performs load sensing control for a delivery flow rate of the main pump in such a manner that a delivery pressure of the main pump becomes higher than a maximum load pressure of the actuators by a target differential pressure, comprising:

a hydraulic motor arranged in a control hydraulic line connecting a hydraulic fluid supply line for supplying the hydraulic fluid from the main pump to the flow control valves, to a tank, the hydraulic motor being drivable by the hydraulic fluid delivered from the main pump;

a generator connected with a rotating shaft of the hydraulic motor;

a control device that performs power generation control of the generator in such a manner that the hydraulic motor is driven by the hydraulic fluid delivered from the main pump when the delivery pressure of the main pump becomes higher than a target control pressure;

a pressure sensor that detects the maximum load pressure; and an electricity storage device that stores electric power generated by the generator, wherein the control device calculates the target control pressure by adding a preset value to the maximum load pressure detected by the pressure sensor, calculates a power generation torque of the generator having a magnitude overcoming a rotating torque of the hydraulic motor caused by the target control pressure, and performs the power generation control of the generator in such a manner that the power generation torque is achieved.

2. The hydraulic drive system for the construction machine according to claim 1, further comprising:

a correction device that corrects the target differential pressure of the load sensing control in such a manner that the target differential pressure decreases with a decrease in a revolution speed of the prime mover, wherein the control device corrects the preset value in such a manner that the preset value decreases with the decrease in the revolution speed of the prime mover.

3. The hydraulic drive system for the construction machine according to claim 1, wherein:

the prime mover includes an electric motor, and the electricity storage device is a power supply for the electric motor.

4. The hydraulic drive system for the construction machine according to claim 2, wherein:

the prime mover includes an electric motor, and the electricity storage device is a power supply for the electric motor.

* * * * *